US005553778A

United States Patent [19]

Jameel et al.

[11] Patent Number: 5,553,778

[45] Date of Patent: Sep. 10, 1996

[54] ADVANCED SOOTBLOWER NOZZLE DESIGN

[75] Inventors: Mohomed I. Jameel, Tucker, Ga.; Donald E. Cormack, Scarborough; Hoc N. Tran, Toronto, both of Canada

[73] Assignee: 3003442 Canada Inc., Toronto, Canada

[21] Appl. No.: 194,877

[22] Filed: Feb. 14, 1994

Related U.S. Application Data

[63] Continuation-in-part of Ser. No. 15,902, Feb. 10, 1993, abandoned.

[51] Int. Cl.[6] ..... F22B 37/54

[52] U.S. Cl. ..... 239/1; 239/450; 239/566; 239/DIG. 13; 239/590; 122/391

[58] Field of Search ..... 15/316.1, 317, 15/318; 134/166 C, 167 C, 168 C; 122/390–392, 382; 239/553, 590, DIG. 13, 450, 566, 1

[56] References Cited

U.S. PATENT DOCUMENTS

| | | | |
|---|---|---|---|
| 837,934 | 12/1906 | Kerr | 239/590 X |
| 1,242,359 | 10/1917 | McKenna | 239/590 |
| 1,377,622 | 5/1921 | Henry | 239/DIG. 13 |
| 1,930,515 | 10/1933 | Eby | 122/391 |
| 3,528,704 | 9/1970 | Johnson | 239/499 |
| 4,014,961 | 3/1977 | Popov | 261/76 |
| 4,261,516 | 4/1981 | Tillman | 239/291 |
| 4,565,324 | 1/1986 | Rebula et al. | 239/DIG. 13 |
| 5,050,805 | 9/1991 | Llyod et al. | 239/424 |
| 5,271,356 | 12/1993 | Kling et al. | 239/518 X |

FOREIGN PATENT DOCUMENTS

| | | | |
|---|---|---|---|
| 2445487 | 8/1980 | France | 122/390 |
| 170991 | 11/1921 | United Kingdom | 122/390 |

*Primary Examiner*—Kevin P. Weldon
*Attorney, Agent, or Firm*—Sim & McBurney

[57] ABSTRACT

A nozzle suitable for use with a device for removal of deposits from contaminated surfaces, such as a sootblower in a heat recovery boiler, is designed to avoid normal shock wave formation, and hence energy dissipation, by achieving a condition whereby, the emergent steam pressure ($p_e$) is related to the ambient pressure ($p_{oo}$) by the relationship $p_e/p_{oo}$<about 2, preferably about 1. A compact design achieving this result and able to function over a wide range of flow rates comprises a cylindrical body with a downstream convergent outlet and a rounded-head conical insert located axially in the body with its maximum dimension generally coinciding with the commencement of convergence of the outlet and extending through the outlet.

22 Claims, 10 Drawing Sheets

ADVANCED SOOTBLOWER NOZZLE DESIGN

This application is a continuation-in-part of U.S. patent application Ser. No. 015,902 filed Feb. 10, 1993 now abandoned.

FIELD OF INVENTION

The present invention relates to the removal of deposits from contaminated surfaces by the use of gas jets, particularly sootblowers employed in heat recovery boilers, and, in particular, to a novel nozzle design for use in connection therewith.

BACKGROUND TO THE INVENTION

In operations in which materials are combusted and heat recovered from the flue gas stream from such combustion, heat-exchange surfaces, usually in the form of banks of tubes, are provided in the flow path of the flue gas. The heat exchange surfaces remove heat from the flue gas stream to a cooler fluid medium flowing through the tubes.

Such operations include combustion furnaces of varying types, including coal-fired boilers, oil-fired boilers and pulp mill recovery furnaces, and generally result in the presence of particulates in the flue gas stream. Some of such particles deposit on and adhere to the exposed tube surfaces. These deposits build up on the tube surfaces and decrease the efficiency of heat transfer from the flue gas stream to the heat-exchanger tubes.

From time-to-time, these deposits are removed by jets of high pressure steam or other suitable gas from a so-called sootblower. A sootblower generally consists of an elongate support rod or lance which reciprocates between the bank of tubes and has a spray head having two opposing convergent-divergent nozzles from which high speed steam jets emanate and are aimed at the heat transfer tubes.

In studying the operation of existing sootblower nozzles, we found that sonic conditions exist at the throat of the nozzle with supersonic flow at the exit and that, a normal shock wave (i.e. a shock wave normal to the direction of gas flow) forms a short distance from the nozzle exit. This shock wave causes a considerable reduction in the stagnation pressure of the steam jet. As a result, there is a substantial reduction of available energy for removal of the deposits on the tube bank.

SUMMARY OF INVENTION

The present invention provides a new nozzle design which does not result in a normal shock wave but rather enables the full force of the steam jet to be applied to the tube bank, thereby enabling a more efficient use of steam energy to be achieved. Our analysis has shown that the cause of the normal shock wave is the presence of an underexpanded jet emanating from the nozzles.

The present invention, therefore, in one aspect, provides an improvement in a device for removal of deposits from contaminated surfaces by the application of gas jets comprising a source of gas and a nozzle operatively connected to the source of gas for the formation of the jets. The improvement comprises constructing and arranging the nozzle such that the pressure of the gas emanating from the nozzle ($p_e$) bears a relation to the ambient pressure ($p_{oo}$) such that a shock wave normal to the flow of the gas jets is not formed.

The novel nozzle geometry provided herein enables proper expansion to be achieved in a compact nozzle structure which permits flexibility of operation over a range of values for the mass flow rate and yet avoids normal shock wave formation.

In another aspect, the present invention provides a method of removing deposits from contaminated surfaces by the application of a gas jet to the surfaces, which comprises forming the gas jet in a nozzle with the pressure of the gas emanating from the nozzle ($P_e$) bearing a relationship to the ambient pressure ($P_{oo}$) surround the nozzle such that a shock wave normal to the flow of the gas jet is not formed. Generally, the gas jet emanating from the nozzle has a supersonic velocity.

This invention is particularly directed to sootblower operations wherein steam is employed as the gas to remove deposits in heat recovery boilers. However, the present invention is broadly directed to a nozzle design for use in any device removing deposits from contaminated surfaces using any form of gas stream.

GENERAL DESCRIPTION OF INVENTION

Figure 1:
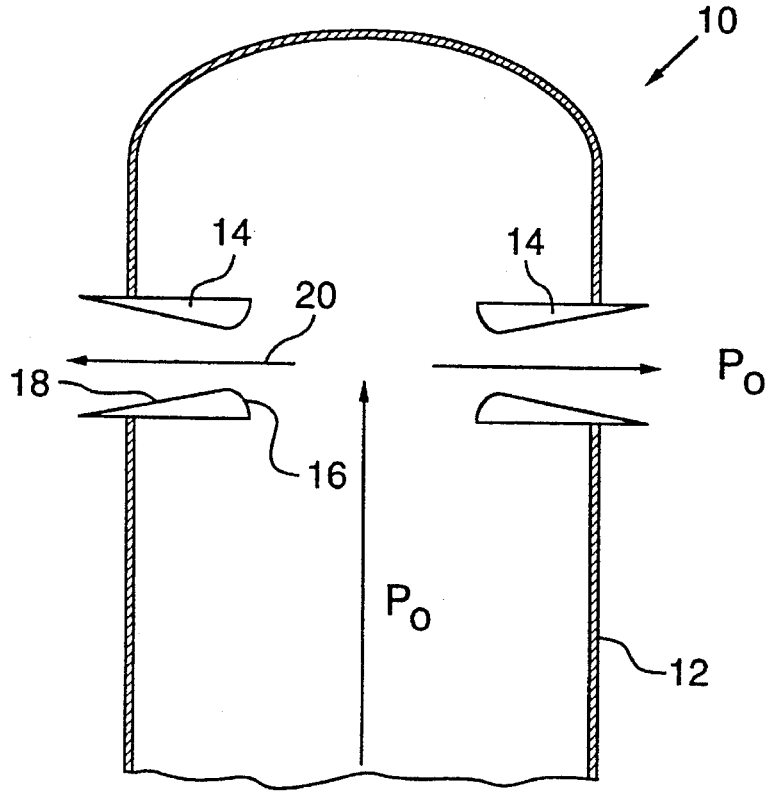
FIG. 1 is a schematic representation of a sootblower lance with a sectional view of conventional convergent-divergent sootblower nozzles.

The hydrodynamic behaviour of pressurized steam flowing through a sootblower nozzle may be considered to resemble that of a gas flowing through a convergent divergent nozzle, as seen in FIG. 1. If $p_o/p_{oo}$ (i.e. the ratio of the stagnation pressure of the gas in the feed pipe to the nozzle to that of the ambient atmosphere beyond the downstream end of the sootblower nozzle)$=[(\gamma+1)/2]^{\gamma/\gamma-1}$, wherein $\gamma$ is the specific heat ratio Cp/Cv of the gas, then the flow in the throat of the nozzle reaches the speed of sound. If $p_o/p_{oo}$ is greater than this critical value, the flow speed in the divergent section of the nozzle becomes supersonic.

For larger values of $p_o$, the pressure at the exit plane of the nozzle ($p_e$) can exceed the ambient pressure ($p_{oo}$) and the gas has to expand outside the nozzle to come into equilibrium with its surroundings. We have found that, if $p_e/p_{oo}$>about 2, there occurs a normal shock wave just downstream of the nozzle, while manipulation of the nozzle design to provide the relationship less than about 2, preferably about 1, avoids formation of the normal shock wave. Increasing the value of $p_o$ means a larger value of $p_e$, which results in a stronger shock wave. The shock wave substantially reduces the stagnation pressure (useful mechanical energy) contained in the steam jet and decreases its effectiveness for cleaning contaminated surfaces.

The problem of the underexpanded gas stream theoretically can be solved by simply extending the downstream portion of the nozzle, so as to properly expand the jet to provide $p_e/p_{oo}$<about 2. However, the resulting nozzle simply is too large to fit into the narrow passages through which the sootblower passes. In addition, this design of nozzle limits the range of mass flow rate of the steam for which proper expansion can be achieved by the nozzle.

The present invention provides a compact nozzle design which permits proper expansion of the gas, so that the formation of the normal shock wave is avoided. In addition, the design permits operation within the same nozzle over a wide range of values for the mass flow rate. This mode of design is highly desirable since expansion of the gas in the divergent section of existing nozzles is governed solely by the diverging walls of the nozzle. The effectiveness of such prior art nozzles is substantially decreased when operated away from design conditions.

Although numerous nozzle designs are possible to achieve the result provided herein, one such nozzle constructed in accordance with the invention comprises a body member having a convergent downstream outlet or lip and a conical insert axially located adjacent the downstream end of such body member and extending therefrom and having a maximum transverse dimension located within the body member, usually adjacent to or upstream of the commencement of convergence of said outlet. The insert may have a streamlined head to facilitate smooth flow of gas in the nozzle.

By employing such design, the nozzle throat is defined by the location of minimum flow area at the lip of the convergent section and the exhausting gas flow is directed towards the surface of the insert by the lip. After the gas has passed the downstream end of the convergent outlet, the gas expands to atmospheric pressure while following the contour of the surface of the conical insert.

A nozzle having this construction may operate under a variety of flow rates. The nozzle is of compact design and hence can readily replace existing sootblower nozzles without introducing space constraints. However, where the provision of the axially-extending conical insert may pose a problem in this regard, the insert may be truncated, with some small loss of efficiency which increases with the degree of truncation.

Alternatively, the head of the lance in which the sootblower nozzles are mounted may be designed to have a reduced diameter in comparison to the remainder of the lance.

The ideal relationship of $p_e$ to $p_{oo}$ is a ratio of 1. At values greater than 1, i.e. $p_e>p_{oo}$, the gas jet is underexpanded and has to undergo a further expansion process outside the nozzle walls, to decrease the jet pressure to that of the ambient. In the design of nozzle just described, any such expansion commences at the tip of the convergent downstream outlet or lip and is directed by both the ambient pressure boundary on one side and the solid boundary of the insert on the other, so as to produce a properly expanded jet ($p_e=p_{oo}$), which flows parallel to the jet axis. The expansion of the gas at the lip is achieved through a simple isentropic Prandtl-Meyer expansion fan. The resultant flow direction, ω, that occurs as the gas expands to a new Mach number M, for a given Prandtl-Meyer fan is:

$$\omega=\sqrt{\frac{\gamma+1}{\gamma-1}}\arctan\left(\sqrt{\frac{\gamma-1}{\gamma+1}}(M^2-1)\right)-\arctan\sqrt{M^2-1} \tag{1}$$

where the specific heat ratio of the gas is $\gamma=c_p/c_v$.

A gas starting at a stagnation pressure $p_o$ expands isentropically according to the equation:

$$\frac{p_o}{p}=\left[1+\frac{\gamma-1}{2}M^2\right]^{\frac{\gamma}{\gamma-1}} \tag{2}$$

Using equation (2), for a desired value of stagnation pressure of the steam or other gas $p_o$, it is possible to determine the corresponding value of the nozzle exit plane Mach number $M_e$ such that $p_e/p_{oo}=1$. Using equation (1), it is possible to determine the optimal inclination of the convergent downstream lip $\omega_e$.

Figure 3:
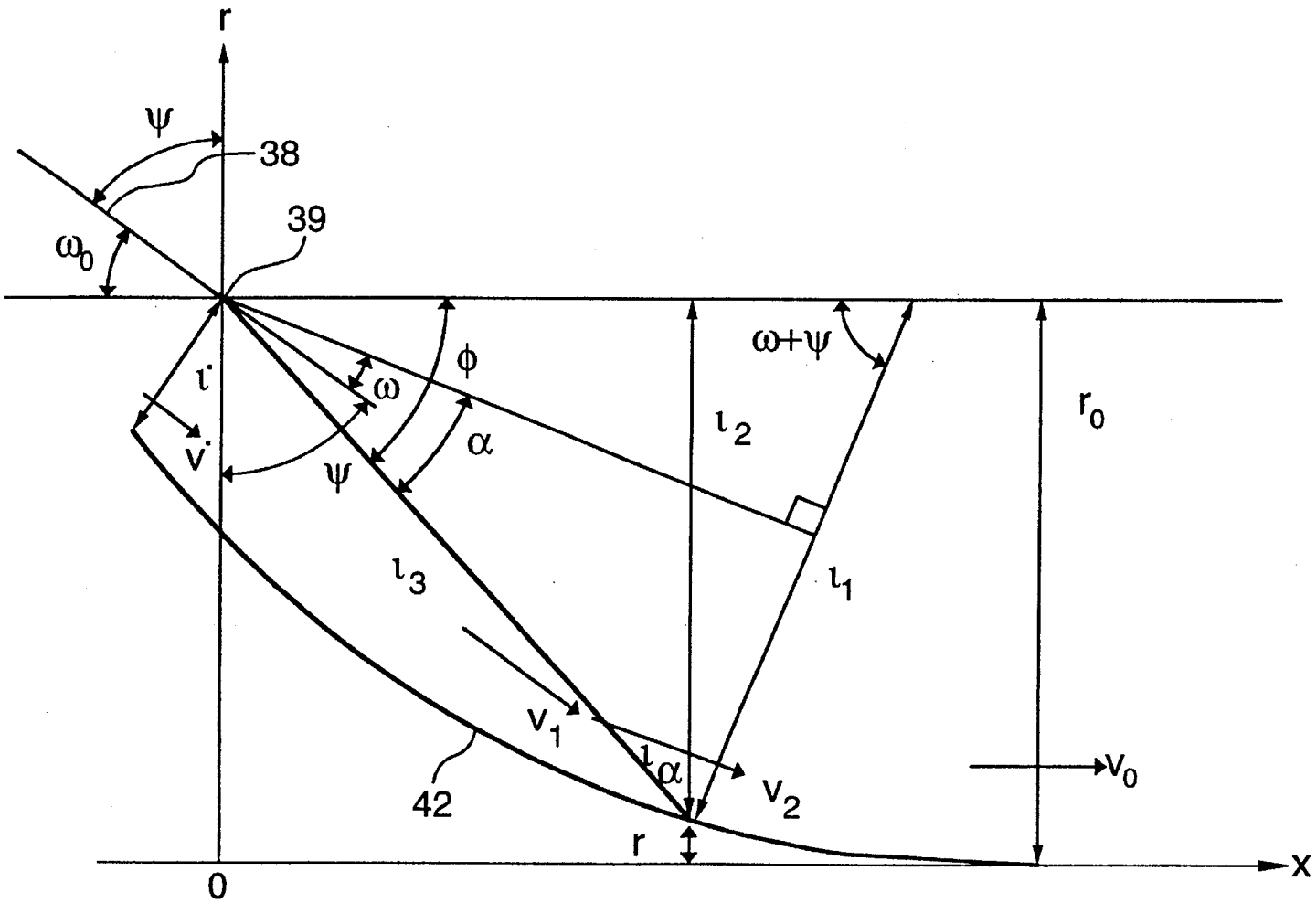
FIG. 3 is a close-up detail of dotted outline area of the nozzle of FIG. 2A.

In FIG. 3, there is shown a detail of the relationship of the downstream tip of the convergent outlet or lip and the outer surface of the insert member. The local radius of the insert is r while that of the jet exit is $r_e$. As seen in FIG. 3, the outer surface of the insert member is illustrated as smoothly curved, which is the theoretically-correct relationship, to provide an axisymmetric relationship in accordance with the analysis made below. As a first approximation, a flat surface, as in a right-conical structure, may be employed. Having regard to the relatively compact dimension of the nozzle provided herein, the utilization of a flat surface leads to little loss in efficiency. The approximate shape of a curved surface which yields a further improved performance can be determined by noting that $l_3$ is the length of the expansion (Mach) wave that originates at the downstream lip of the convergent outlet. The fluid vector v1 crossing this wave is deflected and results in a new vector v2. If ø is the inclination of wave with the nozzle axis, α (α=arcsin (1/M)) is the angle between the Mach wave and the vector v2 and ψ is the inclination of the convergent member or lip with the vertical.

$$\psi=90-\omega_e \tag{3}$$

By simple geometric and trigometric manipulations, it is possible to determine $l_3$ as a function of the flow area $A=\pi(r+r_e)l_3 \sin\alpha$. The isentropic relation between the flow area A, at any location along the nozzle axis, the throat area A* and the local Mach number M is given by the expression:

$$\frac{A}{A^*}=\frac{1}{M}\left[\frac{2}{\gamma+1}\left(1+\frac{\gamma-1}{2}M^2\right)\right]^{\frac{\gamma+1}{2(\gamma-1)}} \tag{4}$$

By commencing at the downstream tip of the insert where Me is known from equation (2) and the area ratio $A_e/A^*$, is obtained from equation (4), it is possible to move progressively upstream towards the nozzle throat using the relation $A/A_e=(A/A^*)(A^*/A_e)$, so as to determine the radial length 13 and the angle ø that the expansion wave makes with the axis. Knowledge of these two parameters then enables one to trace the profile of the insert through a curve in polar coordinates that uses the tip of the lip at the downstream outlet of the convergent nozzle portion at its origin.

It is also possible to further optimize the shape of the insert by computer calculation in which the profile is adjusted until the ratio of axis pressure ($p_e$) to ambient pressure ($p_{oo}$) is unity. It will be appreciated that nozzles which do not possess such highly optimized design may be employed to avoid the problem discussed herein, provided that the ratio of $p_e$ to $p_{oo}$ is such that the shock wave does not form, even though such alternative design may not exhibit as high performance as the optimized nozzle.

A nozzle constructed in accordance with one embodiment of the invention can be dimensioned to correspond to the throat diameter of conventional sootblower nozzles, namely about ⅞ to about 1¼ inches, and can operate over a wide range of values of mass flow rates, for example ranging from about $10^4$ lbm/hr to about $2\times10^4$ lbm/hr, without the formation of a normal shock wave downstream of the nozzle. By avoiding the formation of such shock wave, the nozzle design provided herein permits efficient use one steam energy in cleaning contaminated heat-exchanger surfaces, in contrast to the prior art.

To achieve the above range of mass flow rates to a nozzle of the present invention, applying the approximate design principles described above, the conical insert element may be dimensioned to extend beyond the tip of the lip a distance of about 1.9 to about 2.7 inches, the diameter of the opening providing the lip may be from about 1.5 to about 2.2 inches: and the lip may form an angle of about 35° to about 55°, specifically about 42°, to the axis of the nozzle.

DESCRIPTION OF PREFERRED EMBODIMENT

In FIG. 1, there is illustrated a typical prior art sootblower lance. As seen in FIG. 1, a sootblower 10 comprises an elongate body or lance 12 through which steam passes to opposed outlet nozzles 14, which spray jets of steam towards the surfaces to be cleaned.

The nozzles 14 include a first convergent portion 16 and a second divergent portion 18 defining a throat 20 therebetween, so that the steam first is accelerated and then expanded. The shortcomings of such design under normal sootblower operations have been described above.

Figure 2A:
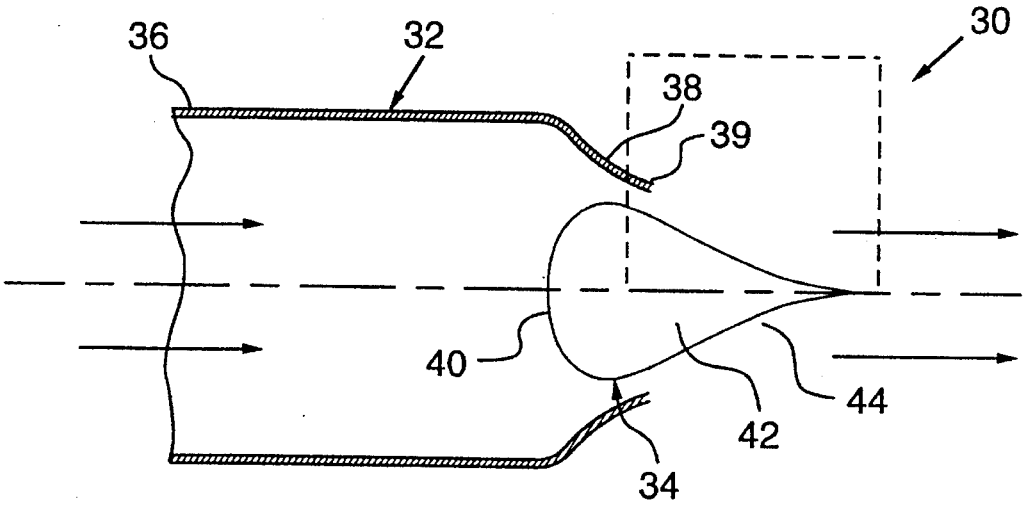
FIG. 2A is a sectional view of a novel sootblower nozzle provided in accordance with one embodiment of the invention.

Turning now to FIG. 2A, there is illustrated therein a novel design of nozzle 30 to replace the conventional convergent-divergent nozzle 14 in sootblower 10. The nozzle 30 comprises a body member 32 and an insert or plug member 34. The body member 32 comprises an upstream cylindrical portion 36 and a downstream convergent portion or lip 38 which terminates at a tip 39.

The insert member 34 comprises a rounded upstream head portion 40 to provide a streamlined gas flow and avoid loss of gas pressure. While a rounded head portion 40 is illustrated, other geometrical shapes may be utilized to provide the streamlined flow, for example, conical. The head portion 40 has a maximum dimension at a location upstream of the lip 39. The insert member 34 also includes a downstream axisymmetric portion 42 which extends through the downstream end of the body member 32 and has an outer surface 44. The relationship of the lip 38 and its tip 39 to the outer surface 44 of the conical insert 34 and the manner in which such relationship provides for proper expansion of the gas stream have been described above with respect to FIG. 3.

The nozzle 30 enables the steam rapidly to achieve ambient pressure without permitting a normal shock wave formation condition to be achieved, thereby overcoming the problem of current nozzle designs.

Figure 2B:
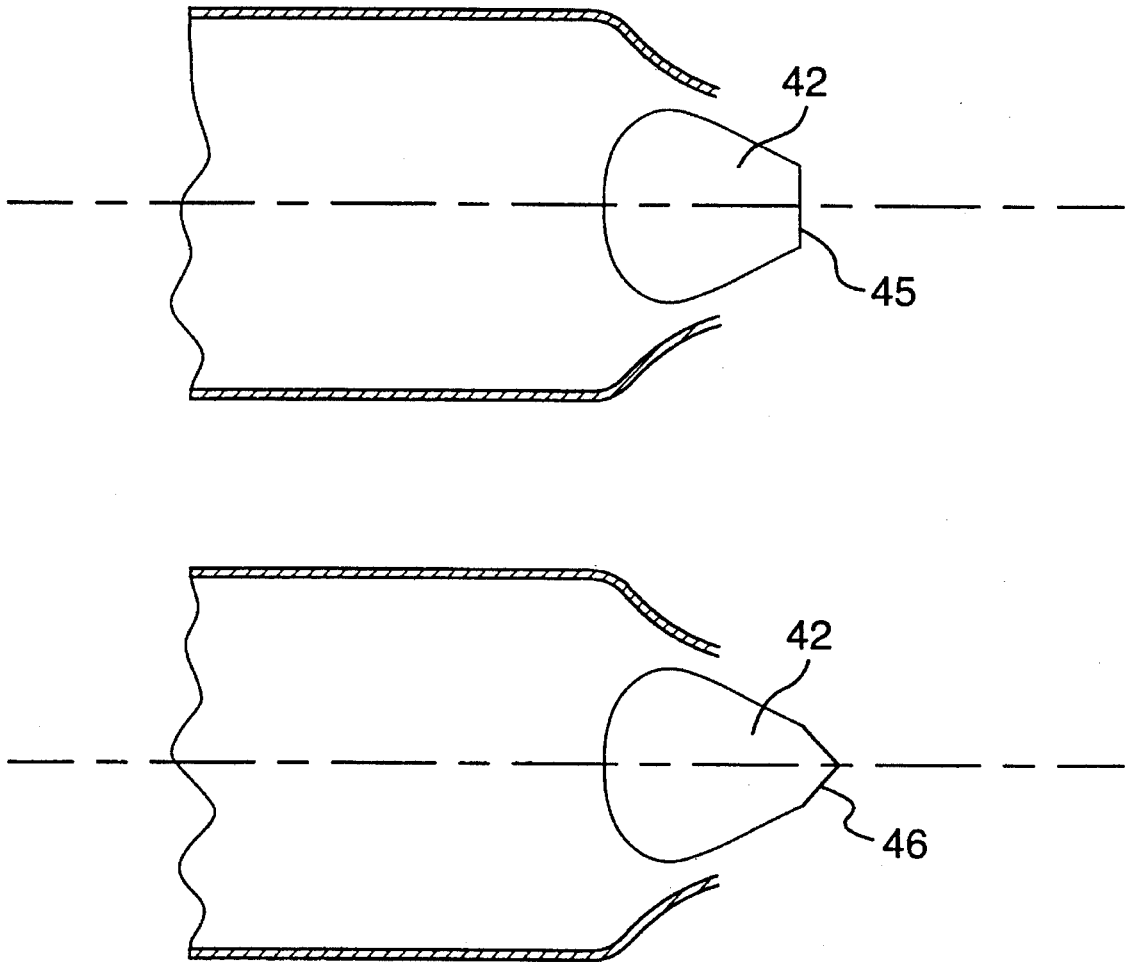
FIG. 2B contains sectional view of two forms of truncated insert in a novel sootblower nozzle provided in accordance with a further embodiment of the invention.

The nozzle 30 also may comprise an insert member 34 which has the axisymmetric body portion 42 truncated, to permit proper expansion of the jet in a shorter overall nozzle length, with only a small degradation in jet stagnation pressure. The designs of such truncated nozzle are shown in FIG. 2B. In the upper design, the axisymmetric portion 42 is to provide a blunt-end 45 while, in the lower design, the downstream portion of the axisymmetric portion 42 provided with a conical end 46, more severely angled than in the immediately upstream portion thereof.

Figure 4A:
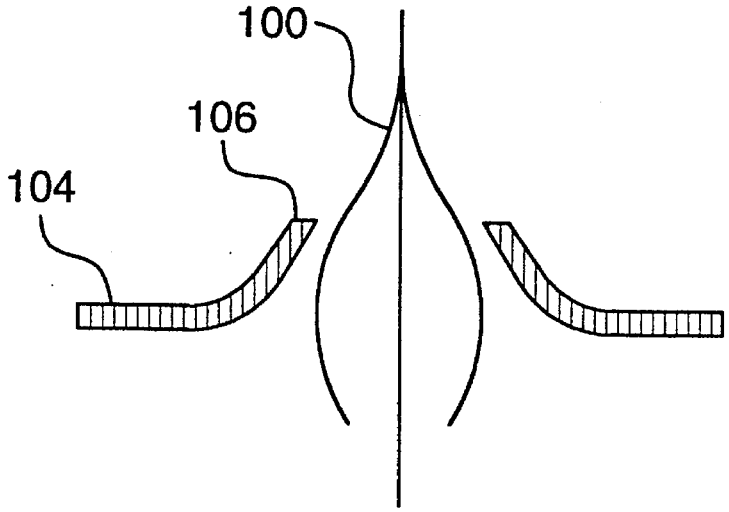
FIGS. 4A and 4B are sectional views of two alternative forms of a novel sootblower nozzle provided in accordance with another embodiment of the invention.
Figure 4B:
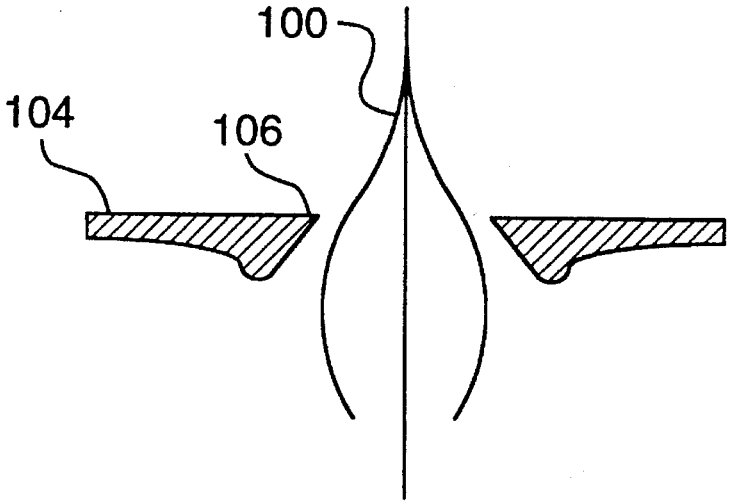
Figure 5A:
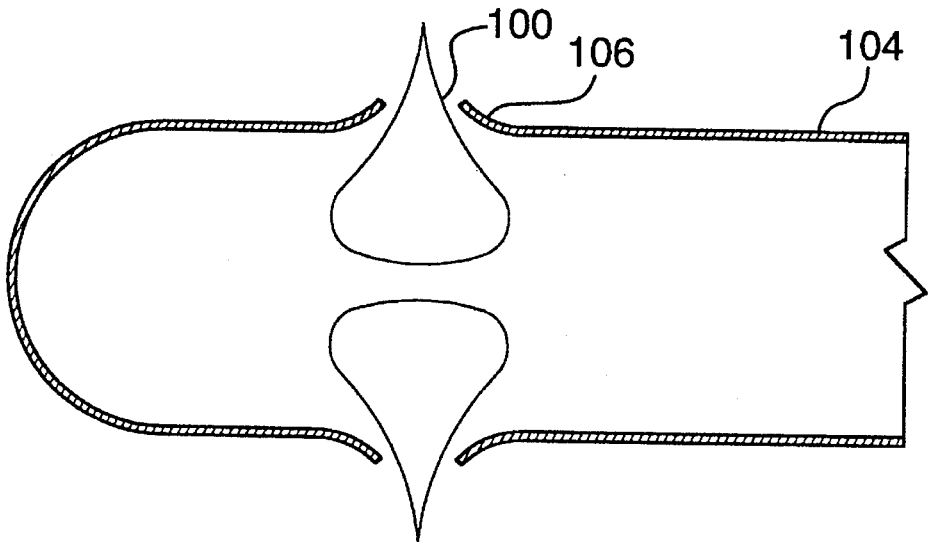
FIGS. 5A and 5B are sectional and perspective views respectively of the head of a sootblower lance incorporating the nozzle of FIG. 4A.
Figure 5B:
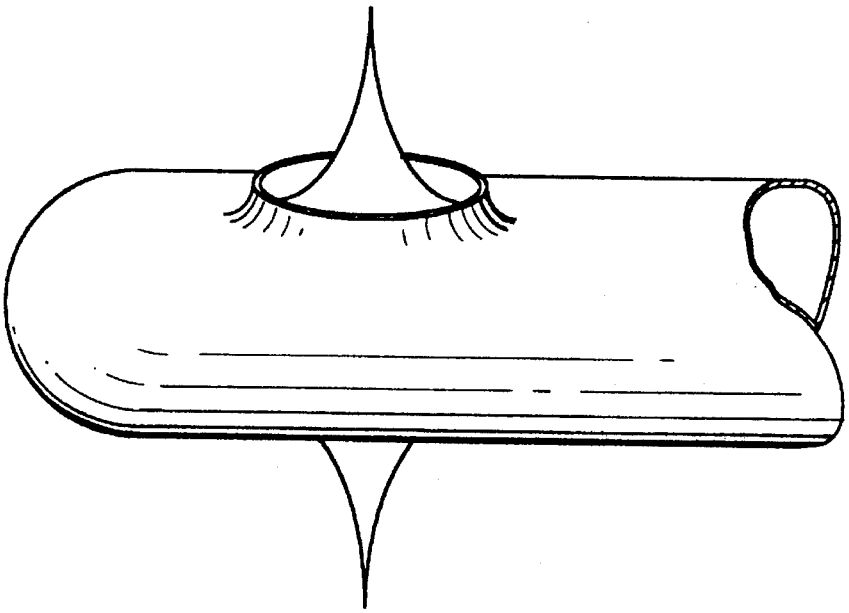

In order to achieve the short overall length which is required to employ the self-adjusting nozzle for the sootblowing application in boilers, the configuration shown in FIG. 4A is preferred. In this embodiment, the conical insert 100 is installed so as to project through an opening 102 in the wall of the lance tube 104. The opening 102 through which the conical insert 100 is equipped with a lip 106 constructed to provide the relationship described above. A more compact design can be provided where the lip 106 lies below the outer surface of the lance tube 104, as shown in FIG. 4B. In the additional Structures described below, all embodiments of the nozzle are depicted with the lip extending beyond the outer surface of the lance as shown in FIG. 4A. However, in all cases the configuration of FIG. 4B may be used. The single nozzle shown in cross section in FIGS. 4A and 4B are best employed in conjunction with a second identical nozzle ejecting in the opposite direction as shown in FIGS. 5A and 5B, in order to balance each other when in operation.

Figure 6A:
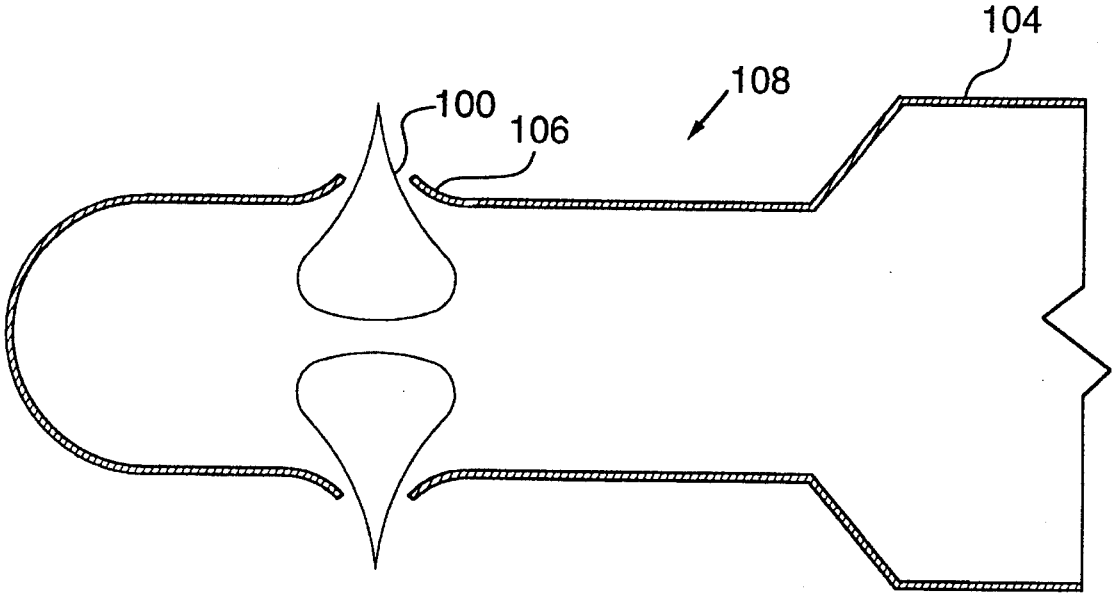
FIGS. 6A and 6B are sectional and perspective views respectively of a modified head of a sootblower lance of reduced dimensions, incorporating the nozzle of FIG. 4A.
Figure 6B:
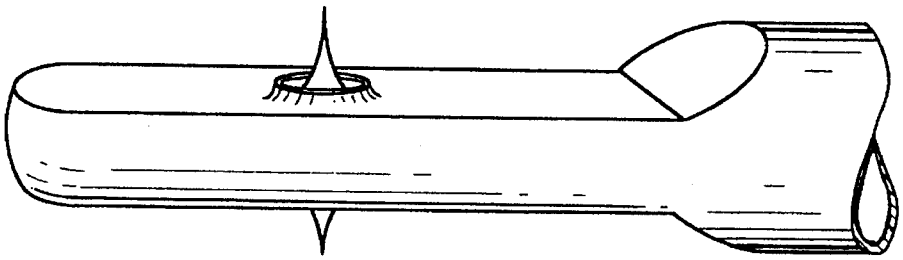

To obtain an even smaller diameter for the lance-nozzle combination, the lance 104 may be provided with an end fixture 108 as shown in FIGS. 6A and 6B of reduced dimension. Using this configuration, the distance between the tips of the conical inserts 100 can be made as small as the diameter of the lance tube 104, so that a sootblower lance incorporating the nozzle structure of the invention may be inserted into the restricted area between the tubes to be cleaned.

Figure 7A:
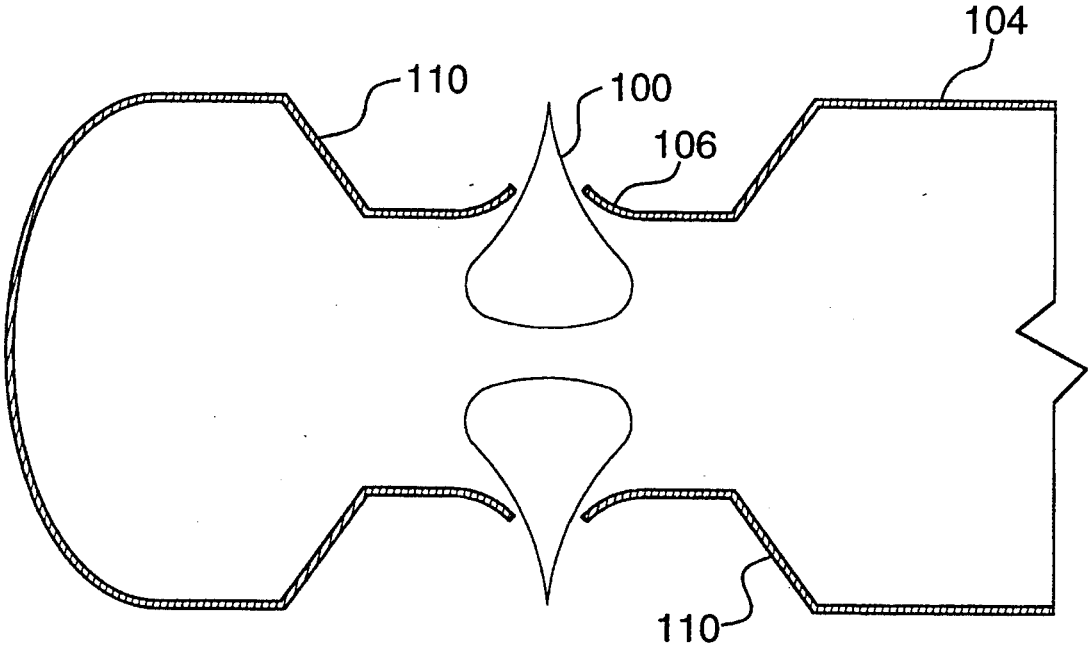
FIGS. 7A and 7B are sectional and perspective views respectively of an alternative modified head of a sootblower lance having a recessed cup configuration and incorporating the nozzle of FIG. 4A.
Figure 7B:
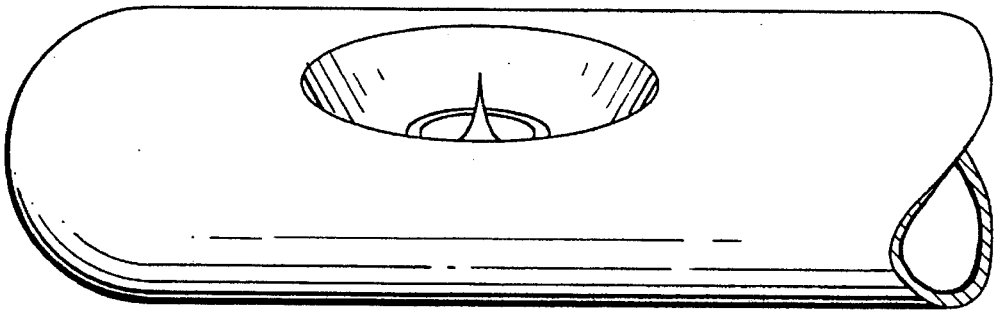

Another configuration which achieves a reduced insert tip to tip distance is shown in FIGS. 7A and 7B. In this structure, the lips 106 and conical inserts 100 are recessed below the outer surface of the lance tube 104 and connected to the lance tube surface by means of cups 110. The lips are formed in the base of the cups 110.

The dimensions of the cups 110 are not critical, except that the base and top diameters of the cups must be large enough so as not to interfere with the gas jet, and so as to allow ambient gases to flow freely to the base of the cup from outside the lance. A base diameter which is approximately 1.3 times the lip diameter, and a top diameter of approximately 1.5 to 2 lip diameters is adequate.

Figure 8A:
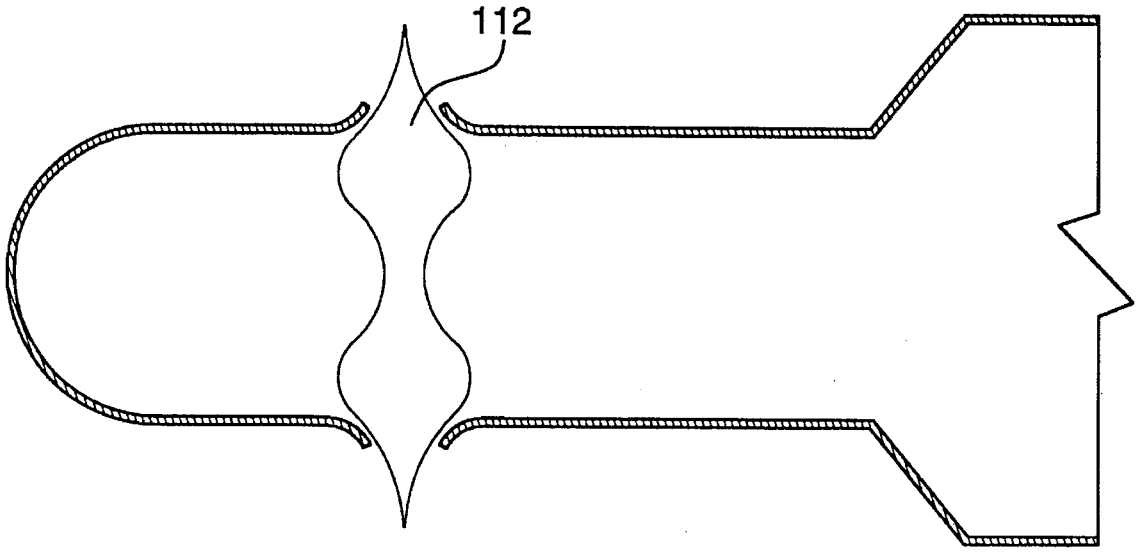
FIG. 8A and 8B are sectional views of other alternative forms of sootblower lance incorporating the nozzle of FIG. 4A and illustrating alternative mounting arrangements for the conical insert.
Figure 8B:
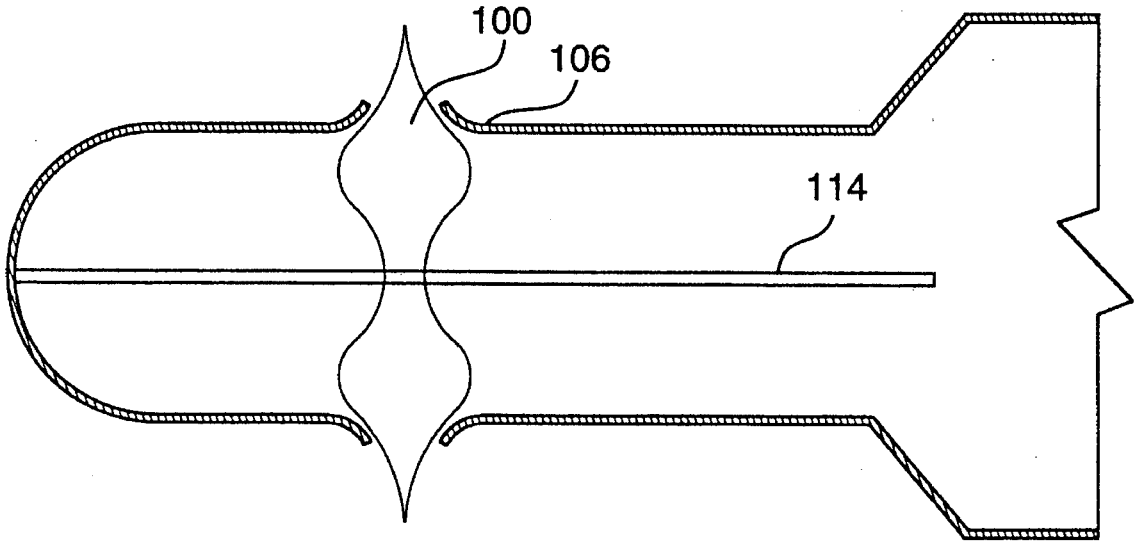

In FIGS. 8A and 8B, there are illustrated a variety of alternative arrangements for mounting the conical insert 100 in the lance. In the structures illustrated in FIGS. 5A, 5B, 6A, 6B and 7A, 7B, the conical inserts 100 may be affixed independently of one another, by means of struts which attach to the sides and end of the lance tube 104. Alternatively, the conical inserts 100, shown as two independent units in FIGS. 5A, 5B, 6A, 6B and 7A, 7B, may be constructed as a single double-ended insert 112, as shown in FIG. 8A, with the single insert 112 being affixed by suitable struts to the lance tube 104 or end-fitting walls.

As an alternative to the struts for mounting the conical inserts 100, the inserts 100 may be mounted on opposite faces of a flat plate 114, which bisects the end fixture along its midplane, parallel to the lip openings, as shown in FIG. 8B. When appropriately positioned, the conical inserts 100 protrude through the lips 106 to the degree required herein. The advantages of this latter arrangement are that the conical inserts are very securely fastened, equal gas flow to each nozzle is assured, and the fabrication process is simplified.

Figure 9A:
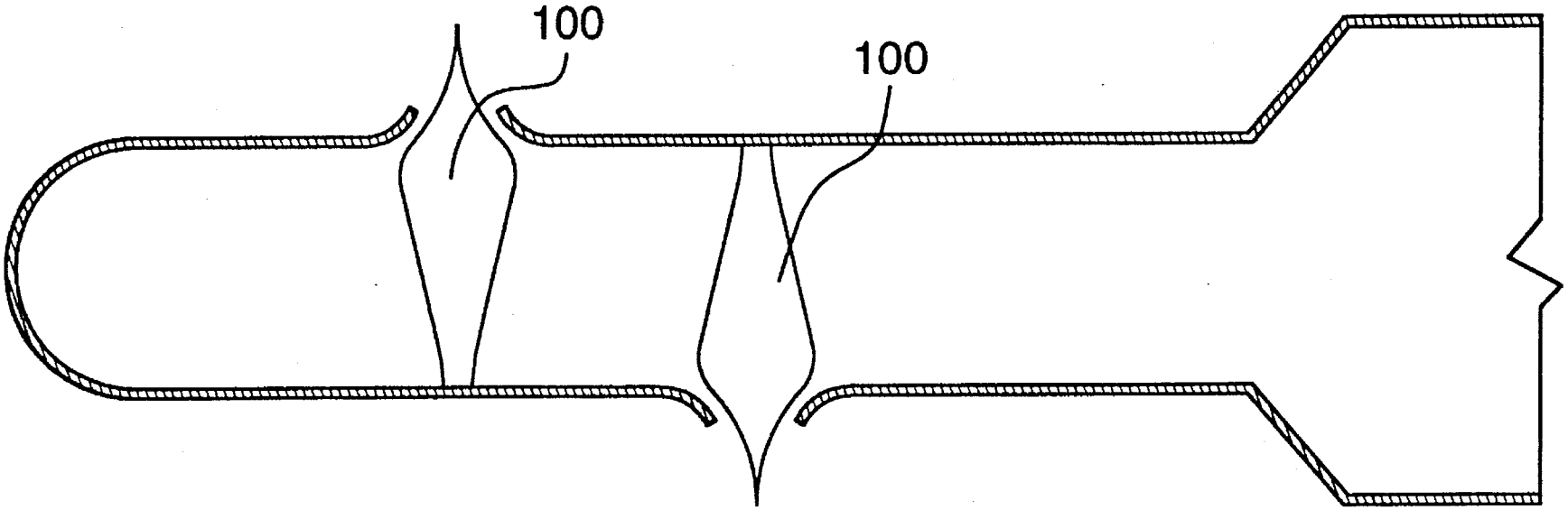
FIGS. 9A, 9B and 9C are sectional views of a sootblower lance having a pair of offset nozzles.
Figure 9B:
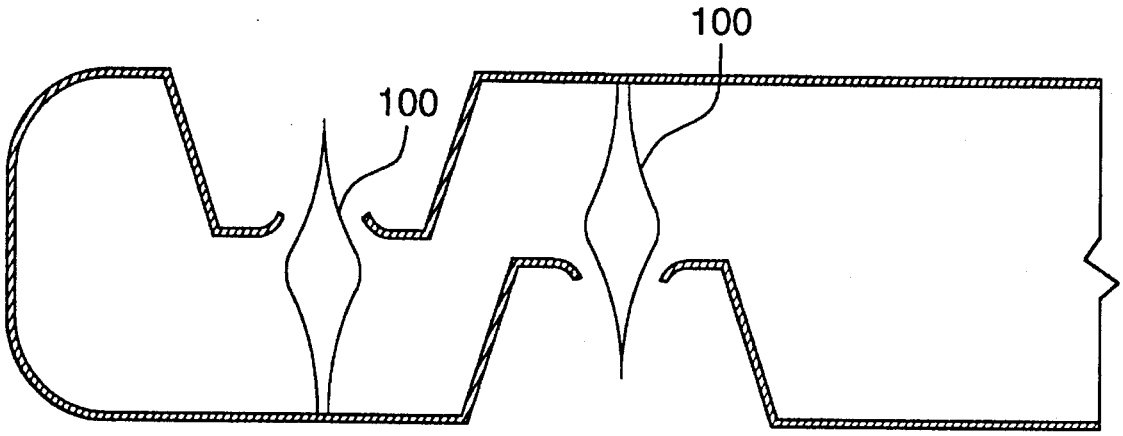
Figure 9C:
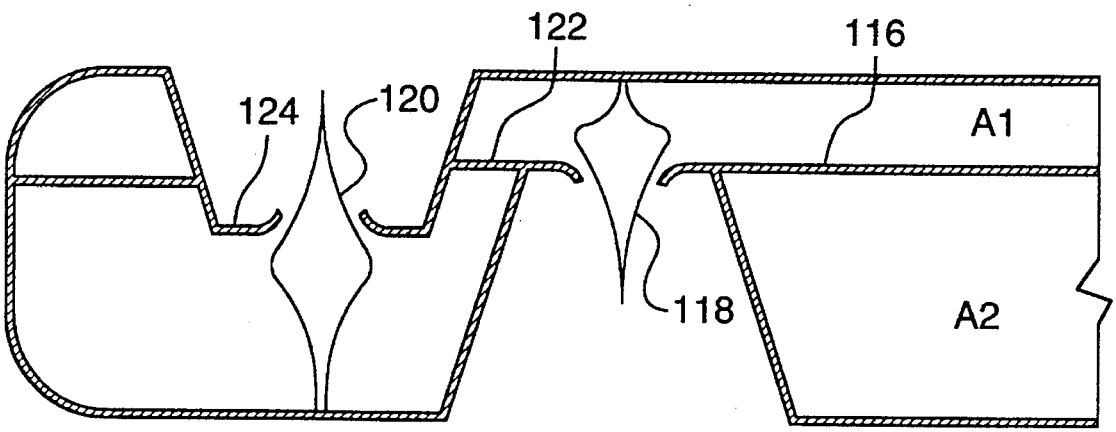

A higher flow rate of gas to a pair of nozzles 100 may be achieved by offsetting the nozzles, as shown in FIG. 9A for an end fixture of reduced dimension and FIG. 9B for the recessed cup arrangement. With these configurations, the conical inserts 100, bolted through the wall or welded, can be attached to the end fixture/lance tube wall opposite to the lips. The recessed cup arrangement gives the minimum resistance for the flow to the second nozzle. A divider plate can be fitted to the recessed cup/offset nozzle arrangement to force an equal flow of gas through both nozzles, as seen in FIG. 9C. The side view shows how the divider plate 116 divides the flow area of the lance into a smaller area, A1, for flow to the upstream nozzle 118 and a larger area, A2, for flow to the downstream nozzle 120. The larger flow area for the downstream nozzle compensates for the obstruction to flow caused by the upstream nozzle. The base of the recessed cup may correspond to the surface of the divider plate so that the hole for the conical insert and associated lips are formed in the divider plate 122. Alternatively, it may be desirable, or necessary, to have one or both of the recessed cups project beyond the divider plate, as shown by 124 in FIG. 9C.

SUMMARY OF DISCLOSURE

In summary of this disclosure, sootblower operation is improved and steam energy usage is enhanced by employing a novel nozzle design which ensures a condition of $p_e/p_{oo}$<about 2 to be achieved, particularly in a compact design. Modifications are possible within the scope of this invention.

What we claim is:

1. A device for removal of deposits from contaminated surfaces by the application of gas jets to said surface, comprising:

a source of gas and a nozzle operatively connected to said source of gas for formation of said gas jets, said nozzle being constructed and arranged such that the pressure of the gas emanating from the nozzle ($p_e$) bears a relation to the ambient pressure ($p_{oo}$) surrounding the nozzle wherein the ratio of $p_e/p_{oo}$ is less than about 2, said nozzle comprising;

a body member and an insert member, said body member comprising a downstream convergent portion terminating in a lip, said insert member having a right; conical body portion coaxially located with respect to the body member and having a decreasing cross-sectional area in the intended flow direction through the nozzle, said insert member having its maximum cross-sectional dimension located within said body member upstream of the lip of said downstream convergent portion and protruding through the lip of said body member to define a throat between the lip of said convergent portion and an adjacent outer surface of said insert member, whereby a shock wave normal to the flow of the gas jets is not formed.

2. The device of claim 1 wherein said conical body portion is axisymmetric and has a concavely-curved outer surface when viewed in cross-section along the longitudinal axis of said conical body.

3. The device of claim 1 wherein said insert member has an upstream rounded head and is located coaxially with said body member.

4. The device of claim 1 wherein said insert member has a maximum dimension located at or upstream of the convergence of the downstream convergent portion of the body member.

5. The device of claim 4 wherein said insert member is truncated at its downstream end.

6. The device of claim 1 wherein the nozzle is constructed such that the velocity of the gas at the downstream end of the conical body portion ($M_e$) is such that $p_e/p_{oo}$=about 1.

7. The device of claim 1 which comprises an elongate hollow lance for feed of gas to said nozzles, a pair of such nozzles mounted on opposite sides of the downstream end of said lance in fluid communication with the hollow interior of the lance for discharge of a gas jet from each nozzle to the ambient atmosphere surrounding said downstream end of said lance.

8. The device of claim 7 wherein at least a portion of said downstream end of said lance has a reduced diameter in comparison to the remainder of the length thereof and said insert members extend through openings formed in said reduced diameter portion.

9. The device of claim 7 wherein said nozzles are provided diametrically opposed alignment.

10. The device of claim 7 wherein said nozzles are provided longitudinal offset from one another.

11. The device of claim 8 wherein said insert members extend through the openings formed in the reduced diameter portion for a distance such that the tips of the insert members do not extend beyond the maximum diameter of the lance.

12. A device for the removal of deposits from contaminated surfaced by the application of gas jets to said surfaces, comprising an elongate hollow lance operatively connected to said source of gas, pair of nozzles mounted on opposite sides of a downstream end of said lance and in fluid flow communication with the hollow interior of the lance for discharge of a gas jet from each nozzle to the ambient atmosphere surrounding said downstream end of each said nozzle comprising:

a body member and an insert member, said body member comprising a downstream convergent portion, said insert member having a conical body portion extending from a maximum dimension located within said body member through the downstream end of said body member to define a throat between a tip of said convergent portion and an adjacent outer surface of said insert member, said downstream convergent portion of each said nozzle comprising a lip of an opening in said hollow lance in which each said insert is mounted, said nozzle being constructed and arranged such that the pressure of the gas emanating from each nozzle ($p_e$) bears a relation to the ambient press ($p_{oo}$) surrounding the nozzle such that a shock wave normal to the flow of gas jets is not formed.

13. The device of claim 12 wherein said lip protrudes from the surface of the lance.

14. The device of claim 12 wherein said lip is formed below the surface of the lance.

15. The device of claim 7 wherein a divider plate is located within the lance in the region of said pair of nozzles to provide separate feeds of gas to individual ones of said pair of nozzles.

16. A device for removal of deposits from contaminated surfaced by the application of gas jets to said surfaces, comprising an elongate hollow lance operatively connected to said source of gas, a pair of nozzles mounted on opposite sides of a downstream end of said lance and in fluid flow communication with the hollow interior of the lance for discharge of a gas jet from each nozzle to the ambient atmosphere surrounding said downstream end of said lance, each said nozzle comprising:

a body member and an insert member, said body member comprising a downstream convergent portion, said insert member having a conical body portion extending from a maximum dimension located within said body member through the downstream end of said body member to define a throat between a tip of said convergent portion and an adjacent outer surface of said insert member, said lance having a divider plate therewithin in the region of said pair of nozzles to provide separate feeds of gas to individual ones of said pair of nozzles, said inserts being mounted to said divider plate, said nozzle being constructed and arranged such that the pressure of the gas emanating from each nozzle ($p_e$) bears a relation to the ambient pressure ($p_{oo}$) surrounding the nozzle such that a shock wave normal to the flow of gas jets is not formed.

17. The device of claim 7 wherein said nozzles are formed at the base of cup-like depression at the downstream end of the lance and said insert members extend through the openings for a distance such that the tips of the insert members do not extend beyond the maximum diameter of the lance.

18. The device of claim 9 wherein the inserts are provided by a single double-ended insert.

19. A device for the removal of deposits from contaminated surfaces by the application of jets to said surfaces, comprising:

a source of gas and a nozzle operatively connected to said source of gas for formation of said gas jets, said nozzle comprising:

a body member and an insert member, said body member comprising a downstream convergent portion, said insert member having a conical body portion extending from a maximum dimension located within said body member through the downstream end of said body member to define a throat between a tip of said convergent portion and an adjacent outer surface of said insert members, the conical insert element being dimensioned and positioned to extend beyond the downstream end of said convergent portion about 1.9 to about 2.7 inches, the diameter of the opening providing said downstream convergent portion being from about 1.5 to about 2.2 inches, said downstream convergent portion defining an angle of about 35° to about 55° with the longitudinal axis of the nozzle, said nozzle being constructed and arranged such that the pressure of the gas emanating from each nozzle ($p_e$) bears a relation to the ambient pressure ($p_{oo}$) surrounding the nozzle such that a shock wave normal to the flow of gas jets is not formed.

20. A method of removing deposits from contaminated surfaces by the application of a gas jet to the surfaces, which comprises:

forming said gas jet in a nozzle with the pressure of the gas emanating from the nozzle ($p_e$) bearing a relationship to the ambient pressure ($p_{oo}$) surrounding the nozzle wherein the ratio of $p_e/p_{oo}$ is less than about 2, and expanding the gas emanating from the nozzle into the ambient atmosphere in accordance with a Prandtl-Meyer expansion fan, whereby a shock wave normal to the flow of the gas jet is not formed.

21. The method of claim 20 wherein said gas jet emanating from the nozzle has a supersonic velocity.

22. The method of claim 20 wherein the gas emanating from the nozzle is expanded into the ambient atmosphere in accordance with a Prandtl-Meyer expansion fan.

* * * * *